United States Patent [19]

Biberbach et al.

[11] 4,155,730

[45] May 22, 1979

[54] ALLOYS FOR JETS, NOZZLES, AND PERFORATED BASE PLATES FOR PRODUCING GLASS FIBERS

[75] Inventors: Elke Biberbach, Hanau; Nils Harmsen, Brüchkobel, both of Fed. Rep. of Germany

[73] Assignee: W. C. Heraeus GmbH, Hanau am Main, Fed. Rep. of Germany

[21] Appl. No.: 862,610

[22] Filed: Dec. 20, 1977

[30] Foreign Application Priority Data

Jan. 29, 1977 [DE] Fed. Rep. of Germany ..... 2703801

[51] Int. Cl.[2] ..... C22C 5/00

[52] U.S. Cl. ..... 65/1; 75/134 N; 75/172 R; 65/374 M

[58] Field of Search ..... 75/172 R, 172 E, 172 G, 75/134 N; 65/12, 1

[56] References Cited

U.S. PATENT DOCUMENTS

| | | | |
|---|---|---|---|
| 2,166,055 | 7/1939 | Jahn et al. | 201/76 |
| 2,566,283 | 8/1951 | Dowson | 18/8 |
| 3,672,880 | 6/1972 | Darling et al. | 75/172 |

FOREIGN PATENT DOCUMENTS

| | | | |
|---|---|---|---|
| 1242921 | 8/1971 | United Kingdom | 75/172 R |
| 1318201 | 5/1973 | United Kingdom | 75/172 R |
| 464634 | 9/1975 | U.S.S.R. | 75/172 |

OTHER PUBLICATIONS

Reinacher et al., ". . . Pt-Pd-Rh alloys at 1200° C." Metall, 27 (1973) 659.

Reinacher, "Stress-rupture of . . . Pt-Pd-Rh alloys" Metall, 29 (1975) 682.

Darling, "The Search . . . Rh-Pt alloys" Platinum Metals Rev. 17 (1973) 130.

*Primary Examiner*—L. Dewayne Rutledge
*Assistant Examiner*—Upendra Roy
*Attorney, Agent, or Firm*—Flynn & Frishauf

[57] ABSTRACT

The invention provides jets, nozzles, and perforated base plates produced from alloys that consist essentially of 40–70% platinum, 20–50% palladium, 5–15% rhodium, and 0.5–4% gold. They are resistant to attack by molten glass, particularly glass containing silicates.

12 Claims, 2 Drawing Figures

ALLOYS FOR JETS, NOZZLES, AND PERFORATED BASE PLATES FOR PRODUCING GLASS FIBERS

The present invention provides alloys containing platinum, palladium, rhodium and gold which are resistant to molten glass (generally referred to as glass melts), and particularly those containing silicates.

BACKGROUND OF THE INVENTION

Platinum and its alloys are widely used in the manufacture of ovens for the glass industry and for crucibles, e.g., nozzles, in the production of glass and mineral fibers (strands) because of their corrosion resistance and mechanical strength.

Generally, these alloys consist of platinum with 5, 10 or 20% by weight rhodium added. Other alloys consist of platinum, palladium and rhodium, e.g., containing more than 30 to less than 89% of platinum, more than 1 to less than 25% rhodium and more than 10 to less than 69% palladium (British Patent No. 1,421,141). Still others comprise 10–30% rhodium or iridium and for 30 to 50% platinum, the remainder being palladium, German OL 1,950,468.

German Patent 1,194,585 which corresponds to British specification 1,064,474 discloses alloys containing in addition to platinum, palladium and rhodium up to 2% of noble metals (by weight).

Platinum alloys containing gold as an alloying element have been suggested as material which is resistant to molten glass. German OL No. 1,533,224 discloses alloys containing 60–97% of platinum, 2 to 25% of rhodium, and 1 to 10% of gold by weight; British Patent No. 1,242,921 discloses alloys containing a minimum of 60% of platinum, 2 to 25% of rhodium, 0 to 20% of iridium, 2 to 10% of gold, 0 to 5% of copper, and 0–10% of palladium.

It is an object of the present invention to provide alloys of platinum, palladium, rhodium and gold which are resistant to molten glass, particularly those containing silicates, and have properties superior to those presently known relative to their use as construction materials for glass processing apparatus.

STATEMENT OF THE INVENTION

The present invention provides alloys comprising between 40 and 70% (by weight) platinum, 20 and 50% palladium, 5 and 15% rhodium, and 0.5 and 4% by gold. These alloys have good physical properties which make them suitable as a construction material for ovens, conduits, orifices, etc., used in processing molten glass, and particularly the silicates which are particularly corrosive to other construction materials.

Figure 2:
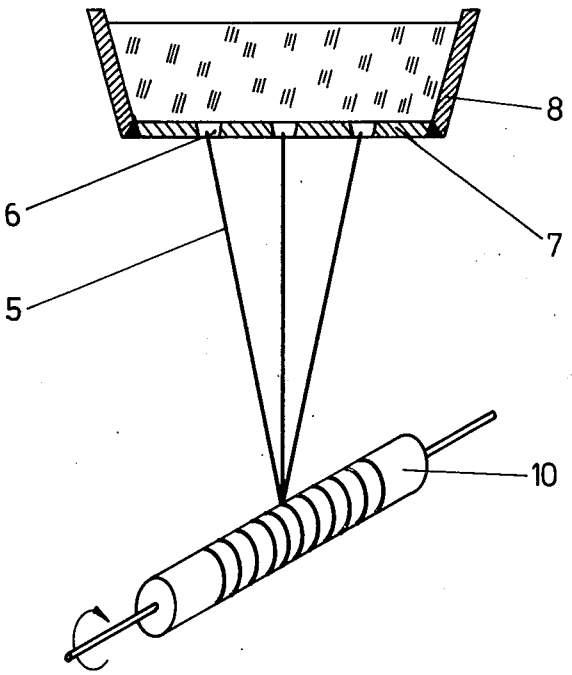
FIGS. 1 and 2 illustrate typical glass filament forming equipment.

The invention is further described with respect to specific examples. All percentages in this specification are by weight unless specified otherwise.

Four alloys designated "A," "B," "C," and "D" were prepared in the usual manner by forming a melt having the specified components. These were then solidified and tested as noted hereinafter.

For producing a jet or nozzle or a base plate for dispensing molten glass in the form of glass fibres the melt of the alloy is solidified, and the resulting bar is cold worked into a sheet. From this sheet a base plate may be produced by drilling orifices in it. Also the sheet or a part of it may be deformed into a jet or nozzle.

TABLE 1

| EX. | PLATINUM % | PALLADIUM % | RHODIUM % | GOLD % |
|---|---|---|---|---|
| A | 42.1 | 40 | 15 | 2.9 |
| B | 47.1 | 40 | 10 | 2.9 |
| C | 62.1 | 20 | 15 | 2.9 |
| D | 67.1 | 20 | 10 | 2.9 |

The platinum-palladium-rhodium-gold alloys of the present invention have higher tensile strength properties than those of the alloys of British Patent No. 1,242,921. They also have very good ductility, good rigidity at elevated temperatures, good weldability, and exhibit only small losses due to volatilization.

The susceptibility of the construction material to wetting by molten glass is an important characteristic for alloys used in the glass industry. The lower the wettability of the alloys, the fewer are the difficulties encountered in processing of molten glass, particularly the drawing (or extrusion) of glass fibers through orifices (nozzles or spinnerettes). These alloys have a good surface condition which is the prerequisite for their very low susceptibility to wetting by molten glass. The alloys of this invention exhibit a shiny metallic to highly polished surface condition even after having been exposed to temperatures of 1300° C. By comparison, the alloys disclosed in British Patent No. 1,242,921 (1) consisting of 77.1% platinum, 10% palladium, 10% rhodium, and 2.9% gold, and (2) those consisting of 72.1% platinum, 10% palladium, 15% rhodium, and 2.9% gold, have surfaces which are marred as a consequence of thermal atmospheric etching.

The table which appears on the following page reports physical properties for the alloys of Examples A, B, C and D, and also comparative properties for prior art alloys.

TABLE 2

| Alloy (Composition %) Weight | Density (g/cm$^3$) | Grain Size ASTM Standard E 112 | Hardness[1] HV1[1] | Tensile[2] Strength (daN/mm$^2$) | Yield[2] Point (daN/mm$^2$) | Tensile[3] Strength at 1300° C. (daN/mm$^2$) | Yield[3] Point at 1300° C. (daN/mm$^2$) |
|---|---|---|---|---|---|---|---|
| 80Pt 20Rh | 18.7 | 5.5 | 110 | 38 | 9.7 | 5.4 | 4.2 |
| 50Pt 40Pd 10Rh | 15.4 | >0–2.5 | 100 | | | | |
| 65Pt 20Pd 15Rh | 16.9 | 1–1.5 | 115 | 40 | 14 | 4.4 | 3.5 |
| 77.1Pt 10Pd 10Rh$_4$ 2.9Au | 18.4 | 2.5–3 | 130 | 39 | 17 | | |
| 72.1 Pt 10 Pd 15 Rh$_4$ 2.9Au | 18.0 | 1.5–2 | 135 | 45 | 20 | | |
| Alloy A | 15.0 | 4 | 135 | 49 | 21 | 4.7 | 4.6 |
| Alloy B | 15.4 | 4–4.5 | 140 | 45 | 17 | 3.7 | 3.6 |

TABLE 2-continued

| Alloy (Composition %) Weight | Density (g/cm³) | Grain Size ASTM Standard E 112 | Hardness[1] HV1[1] | Tensile[2] Strength (daN/mm²) | Yield[2] Point (daN/mm²) | Tensile[3] Strength at 1300° C. (daN/mm²) | Yield[3] Point at 1300° C. (daN/mm²) |
|---|---|---|---|---|---|---|---|
| Alloy C | 16.9 | 1 | 155 | 50 | 21 | 6.0 | 5.7 |
| Alloy D | 17.4 | 1-2.5 | 135 | 46 | 18 | 4.5 | 4.4 |

1. After exposure to 1300° C. for seven days.
2. Soft (not worked).
3. At 1300° C.
4. According to the U.K. patent No. 1.242.921.

The alloys of this invention are used as construction material in the glass making industry, for example in melting glass and in producing glass fibres.

For melting glass is introduced into a container at least part of which is formed from an alloy consisting essentially of 40–70% by weight platinum, 20–50% palladium, 5–15% rhodium, and 0.5–4% gold, and heating the container to melt the glass.

The use of the alloys of this invention as construction material preferably in producing glass fibres or filaments will be described by way of two examples with reference to FIGS. 1 and 2, respectively.

Figure 1:
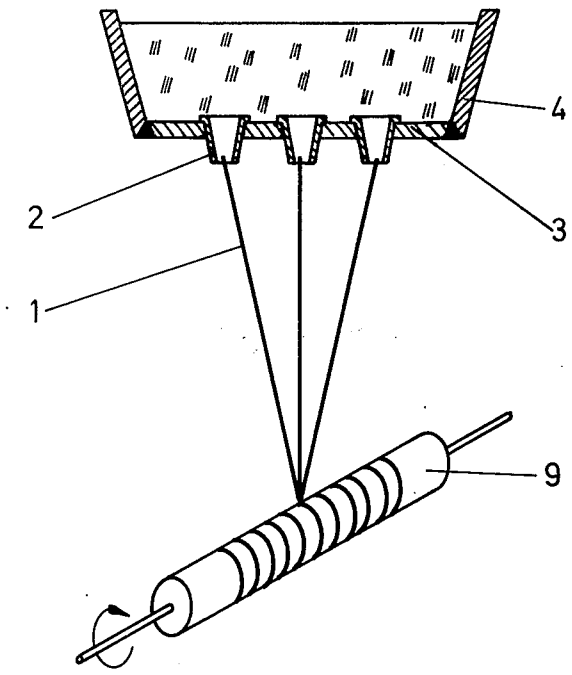

In the method of dispensing molten glass in the form of glass fibres or filaments the glass fibres 1 as shown in FIG. 1 are expelled through a series of spinning jets or nozzles 2 mounted in the base plate 3 of the spinning box 4 containing the molten glass, which jets or nozzles are fabricated from an alloy consisting essentially of 40–70% by weight platinum, 20–50% palladium, 5–15% rhodium, and 0.5–4% gold or the glass fibres 5 as shown in FIG. 2 are expelled through a plurality of closely spaced orifices 6 in the base plate 7 of the spinning box 8 containing the molten glass, which base plate is fabricated from an alloy consisting essentially of 40–70% by weight platinum, 20–50% palladium, 5–15% rhodium, and 0.5–4% gold. In both figures the glass fibres are spooled on the drum 9 and 10, respectively.

The alloys of the present invention preferably consist essentially of 42.1–67.1% by weight platinum, 20–40% by weight palladium, 10–15% by weight rhodium, and 2.9% by weight gold.

We claim:

1. A jet or nozzle mounted in the base plate of a spinning box for producing glass fibres, said jet or nozzle being manufactured of an alloy consisting essentially of 40–70% by weight platinum, 20–50% palladium, 5–15% rhodium, and 0.5–4% gold.

2. The alloy of claim 1 consisting essentially of 47.1% platinum, 40% palladium, 10% rhodium, and 2.9% gold.

3. The alloy of claim 1 consisting essentially of 42.1% platinum, 40% palladium, 15% rhodium, and 2.9% gold.

4. The alloy of claim 1 consisting essentially of 67.1% platinum, 20% palladium, 10% rhodium, and 2.9% gold.

5. The alloy of claim 1 consisting essentially of 62.1% platinum, 20% palladium, 15% rhodium, and 2.9% gold.

6. The alloy of claim 1 consisting essentially of 42.1–67.1% platinum, 20–40% palladium, 10–15% rhodium and about 2.9% gold.

7. A base plate of a spinning box for producing glass fibres, said base plate having a plurality of closely spaced orifices, said base plate being manufactured of an alloy consisting essentially of 40–70% by weight platinum, 20–50% palladium, 5–15% rhodium, and 0.5–4% gold.

8. The alloy of claim 7 consisting essentially of 47.1% platinum, 40% palladium, 10% rhodium, and 2.9% gold.

9. The alloy of claim 7 consisting essentially of 42.1% platinum, 40% palladium, 15% rhodium, and 2.9% gold.

10. The alloy of claim 7 consisting essentially of 67.1% platinum, 20% palladium, 10% rhodium, and 2.9% gold.

11. The alloy of claim 7 consisting essentially of 62.1% platinum, 20% palladium, 15% rhodium, and 2.9% gold.

12. The alloy of claim 7 consisting essentially of 42.1–67.1% platinum, 20–40% palladium, 10–15% rhodium and about 2.9% gold.

* * * * *